US006218784B1

(12) United States Patent
Jang et al.

(10) Patent No.: US 6,218,784 B1
(45) Date of Patent: Apr. 17, 2001

(54) PLASMA DISPLAY PANEL APPARATUS HAVING A DRIVING CIRCUIT UNIT THEREON

(75) Inventors: Woo-Sung Jang, Seoul; Je-Seok Kim, Ahnyang, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/448,874

(22) Filed: Nov. 24, 1999

(30) Foreign Application Priority Data

Nov. 26, 1998 (KR) ..... 98-50911

(51) Int. Cl.[7] ..... G09G 3/10

(52) U.S. Cl. ..... 315/169.1; 315/169.4; 313/257; 313/268; 313/292

(58) Field of Search ..... 315/169.1, 169.4; 313/238, 250, 268, 257, 292, 496; 345/37, 41, 42; 445/24

(56) References Cited

U.S. PATENT DOCUMENTS 5,477,105 * 12/1995 Curtin et al. ..... 313/422
5,672,083 * 9/1997 Curtin et al. ..... 445/25
5,859,508 * 1/1999 Ge et al. ..... 315/366

* cited by examiner

*Primary Examiner*—Haissa Philogene
(74) *Attorney, Agent, or Firm*—Fleshner & Kim, LLP

(57) ABSTRACT

In the present invention, it is possible to implement a small size and light PDP apparatus by integrally forming a panel unit and a driving circuit unit on a single substrate. A panel unit(discharge cells) of the PDP is formed on one surface of a flat metallic substrate, and a driving circuit unit is formed on the other surface of the same. Namely, in the PDP apparatus having a panel unit formed of a plurality of discharge cells, and a driving circuit unit for supplying a power and signal to the panel unit, the PDP apparatus includes a metallic lower substrate, a first insulation layer formed on an upper surface of one side of the metallic lower substrate, an upper substrate formed opposite to the one side of the metallic lower substrate, a plurality of barriers formed between the metallic lower substrate and the upper substrate for defining a plurality of discharge spaces, and a second insulation layer formed on another surface of the metallic lower substrate and including the driving circuit unit thereon.

14 Claims, 4 Drawing Sheets

PLASMA DISPLAY PANEL APPARATUS HAVING A DRIVING CIRCUIT UNIT THEREON

BACKGROUND OF THE INVENTION

1. Field of the Invention

The present invention relates to a PDP(Plasma Display Panel) apparatus, and in particular to a PDP apparatus combined a PCB(Printed Circuit Board) substrate on which formed driving circuits and panel unit into a single body. The panel unit includes two flat type substrates facing each other and a plurality of discharge cells disposed between the two flat type substrates.

2. Description of the Background Art

Recently, a flat panel display such as a LCD(Liquid crystal display), a FED(Field emission display), a PDP (Plasma Display Panel), etc. is intensively studied. Among the above-described units, the PDP is a display apparatus and attracts a big attention based on its advantage such as an easier fabrication due to its simple structure, a high luminance and high light emitting efficiency, a good memory function, and a wider view angle above 160 for thereby implementing a large size screen above 40 inches.

The PDP apparatus includes a panel unit formed of a plurality of discharge cells, and a driving circuit unit for supplying a power or signal to the panel unit.

The panel unit is formed of a pair of glass base plates, and a plurality of discharge cells disposed therebetween.

The driving circuit for driving the panel unit is installed on a PCB(Printed Circuit Board) substrate. In addition, the discharge cells of the panel unit and the driving circuit formed on the PCB substrate are connected by a certain known method.

FIG. 1 is an exploded respective view illustrating a panel unit of a conventional PDP apparatus.

As shown therein, the panel unit of the conventional PDP apparatus includes two glass substrates 10 and 20, and a plurality of discharge cells 30 formed therebetween. Among two glass substrates 10 and 20, the glass substrate 10 is a front substrate 10 for displaying a certain character or image, and the other glass substrate 20 is a rear substrate 20.

A plurality of address electrodes 21 are parallely formed at a certain distance on the upper surface of the rear substrate 20 formed of a glass material, a dielectric layer 22 is formed on the upper surfaces of the address electrodes 21 and the rear substrate 20, and a barrier 23 is formed between each neighboring address electrodes 21 for separating the discharge cells 30. A fluorescent substance layer 24 is formed at a lateral wall of the barrier 23 of each discharge cell 30 and on the upper surface of the dielectric layer 22.

A pair of sustain electrodes 11 are formed in parallel on the lower surface of the front substrate 10 which is another glass substrate, and a dielectric layer 12 is formed on the lower surfaces of the sustain electrodes 11 and the front substrate 10, and a dielectric layer protection film 13 is formed on the surfaces of the dielectric layer 12.

The panel unit of the PDP is formed by bonding the front substrate 10 and the rear substrate 20.

However, the apparatus for displaying a certain character or image is not implemented by the above-described panel unit. Namely, a PDP driving circuit unit is used for applying a certain voltage and signal to the panel unit. In addition, the PDP driving circuit unit is generally a PCB(Printed Circuit Board) substrate which is formed by disposing a plurality of driving circuit integration devices on a substrate having printed wires thereon for driving the panel unit. In addition, the electrodes of the panel units and the circuit of the driving circuit unit are electrically connected for thereby implementing a PDP apparatus.

The conventional method for electrically connecting the panel unit and the driving circuit unit will be explained.

FIGS. 2A through 2C illustrate the method for electrically connecting the panel unit and the PDP driving circuit of FIG. 1.

FIG. 2A illustrates a structure of the PDP apparatus in which the driving circuit unit, namely, a PCB substrate 101 is disposed under the panel unit 100, and the electrodes of the panel unit 100 and the driving circuit of the PCB substrate 101 are connected by a conductive rubber 102.

FIG. 2B illustrates a structure that the PCB substrate 104 is installed near the panel unit 103, and the panel unit 103 and the PCB substrate 104 are connected by a thermal pressing method.

FIG. 2C illustrates a method for installing the PCB substrate 107 under the panel unit 106 and connecting the electrodes of the panel unit 106 and the driving circuit of the PCB substrate by disposing therebetween a flexible printed circuit 108 formed of an anisotropic conductive film.

However, in the above-described conventional PDP apparatus, since the PCB having the panel unit and driving circuit is formed at different substrates, respectively, the size and weight of the PDP apparatus are increased.

SUMMARY OF THE INVENTION

Accordingly, it is an object of the present invention to provide a PDP apparatus which is capable of significantly decreasing a size and weight of a PDP apparatus by integrally forming a panel unit and driving circuit unit on a single substrate.

To achieve the above object, there is provided a PDP apparatus in which a panel unit(discharge cell) is formed on one surface of a flat metallic substrate, and a driving circuit unit is installed on another surface thereof.

To achieve the above object, there is provided a PDP apparatus according to the present invention which includes a metallic lower substrate, a first insulation layer formed on an upper surface of one side of the metallic lower substrate, an upper substrate formed opposite to the one side of the metallic lower substrate, a plurality of barriers formed between the metallic lower substrate and the upper substrate for defining a plurality of discharge spaces, and a second insulation layer formed on another surface of the metallic lower substrate and including the driving circuit unit thereon.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The structure of a PDP(Plasma Display Panel) apparatus according to the present invention will be explained with reference to the accompanying drawings.

Figure 1:
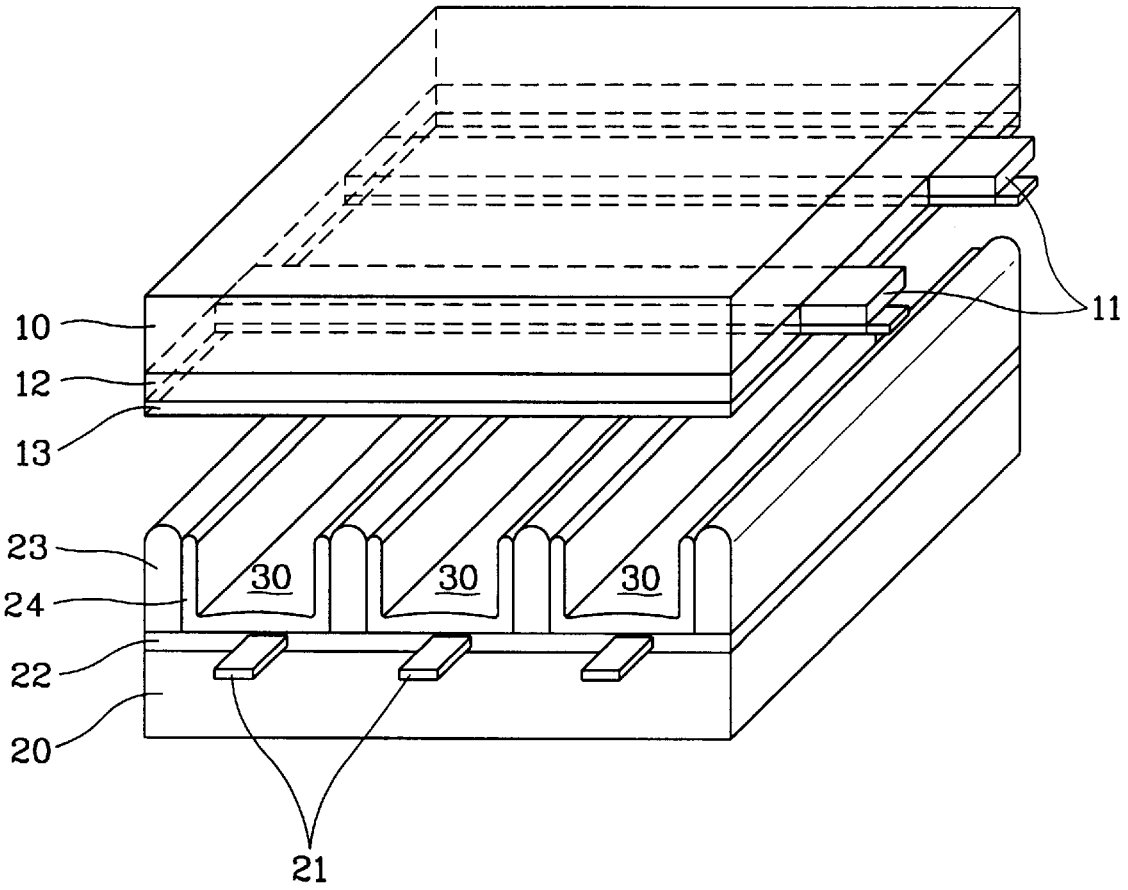
FIG. 1 CONVENTIONAL ART
FIG. 1 is an exploded perspective view illustrating a panel unit of a conventional PDP(Plasma Display Panel) apparatus.
Figure 2A:
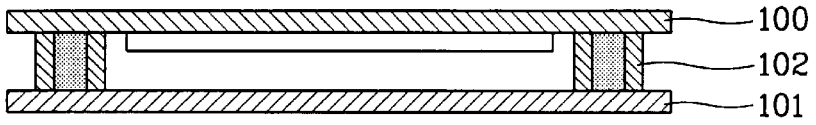
FIG. 2A CONVENTIONAL ART
FIGS. 2A through 2C are views illustrating an electrical connection structure of a panel unit and a driving circuit unit of a conventional PDP apparatus.
Figure 2B:
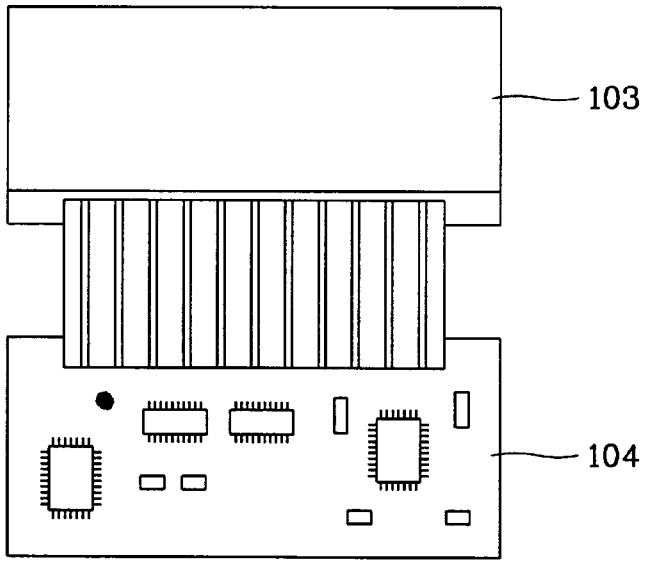
FIG. 2B CONVENTIONAL ART
Figure 2C:
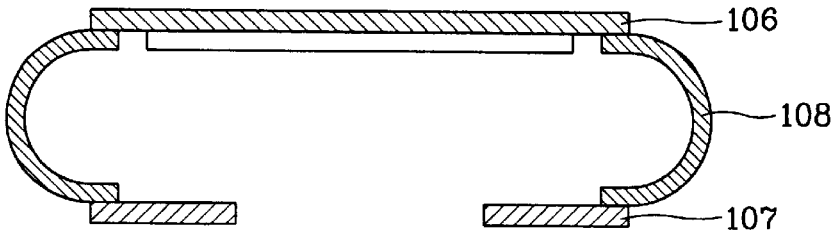
FIG. 2C CONVENTIONAL ART
Figure 3:
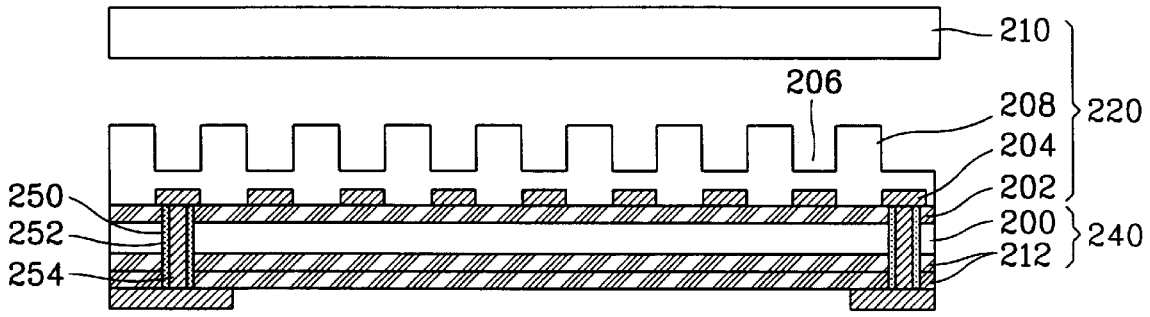
FIG. 3 is a view illustrating a PDP apparatus according to a first embodiment of the present invention.

FIG. 3 is a vertical cross-sectional view illustrating the PDP apparatus according to the present invention. As shown therein, a plate shaped metallic substrate 200 is provided. A panel unit 220 of a PDP apparatus is formed on the metallic substrate 200, and a PDP driving circuit unit 240 is formed under the metallic substrate 200.

The driving circuit unit 240 will be explained.

A first insulation layer 212 is formed on a lower surface of the metallic substrate 200. The first insulation layer 212 is preferably formed of a green tape. The first insulation layer 212 may be formed of one layer of the green tape. A plurality of layers of the green tape may be stacked.

A driving circuit 214 formed of wires for connecting the driving circuit integration device and integration circuit device is disposed on the surface of the first insulation layer 212 for driving the PDP apparatus. Namely, the metallic substrate 200 operates as a base plate of a PCB(Printed Circuit Board). The driving circuits are formed on the lower surface of the metallic substrate 200 which operates as the base plate.

Therefore, the metallic substrate 200 operates as a rear substrate of the panel unit of the PDP and is used as a base plate of the PCB.

Next, the panel unit 220 formed of a plurality of discharge cells between two opposite substrates will be explained.

A second insulation layer 202 is formed on an upper surface of the metallic substrate. A plurality of address electrodes 204 are formed in parallel at a certain distance from each other on the upper surface of the second insulation layer 202. In addition, A barrier 208 is formed between the neighboring address electrodes 204 and on the upper surface of the second insulation layer 202 for separating each discharge cell 206. The barrier 208 may be formed by a mold method using a green tape, and may be formed by a screen painting method using an insulation paste and may be formed by a known barrier formation method. In addition, the second insulation layer 202 is preferably formed of a green tape. A glass substrate 210 is installed on an upper portion of the barrier 208. Here, the metallic substrate 200 is a rear substrate of the PDP, and a plurality of discharge cells 206 which are defined by each barrier 208 are formed between the rear substrate 200 and the front substrate 210.

The driving circuit of the driving circuit unit and the electrode installed at the PDP panel unit are connected as follows. Namely, a through hole 250 is formed at an edge portion of the metallic substrate 200, and an insulation film 252 is coated on an inner wall of the through hole 250. A conductive plug 254 is formed in the through hole 250.

Namely, the through hole 250 is formed at the metallic substrate 200, and the insulation film 252 is coated on an inner wall of the through hole 250. In addition, the conductive plug 254 is formed in the through hole 200 surrounded by the insulation film 252. The panel unit of the PDP and the driving circuit unit are electrically connected by the conductive plug 254.

Therefore, in the present invention, it is possible to implement an integral panel unit and driving unit by patterning a circuit on the green tape attached to a lower portion of the metallic substrate and mounting the PDP driving integration circuit device. As a result, the weight and size of the PDP apparatus are decreased, and the thickness of the same is decreased. In addition, it is possible to implement a small size and light and thin system.

Figure 4:
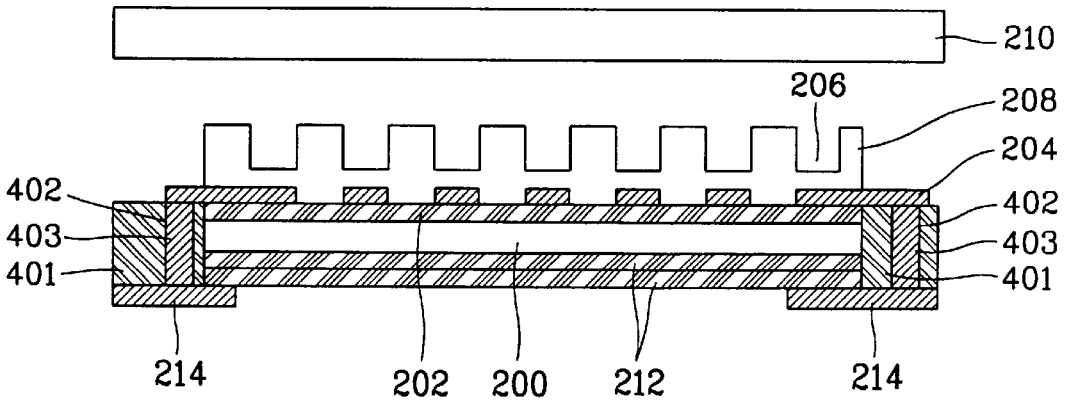
FIG. 4 is a view illustrating a PDP apparatus according to a second embodiment of the present invention.

FIG. 4 is a view illustrating a PDP apparatus according to a second embodiment of the present invention. As shown therein, the elements of the second embodiment of the present invention is the same as the first embodiment of the present invention, but a method according to the second embodiment of the present invention for connecting the electrodes of the PDP panel unit and the driving circuits is different from the first embodiment of the present invention. The same reference numerals of the first and second embodiments of the present invention are given to the same elements of the same. The same elements as the elements of the first embodiment will not be described.

In the PDP apparatus according to the second embodiment of the present invention, an insulation member 401 is formed on an outer circumferential surface of the metallic substrate 200, and the electrical connection portions of the PDP panel unit 220 and the driving circuit unit 240 are formed at the insulation member 401. In the present invention, the insulation body is formed of a green tape.

Namely, an insulation member 401 is formed at an edge portion of the metallic substrate 200, and a through hole 402 is formed at the insulation member 401. A conductive plug 403 is filled in the through hole 402. The PDP panel unit and the driving circuits are connected by the conductive plug 403.

Figure 5:
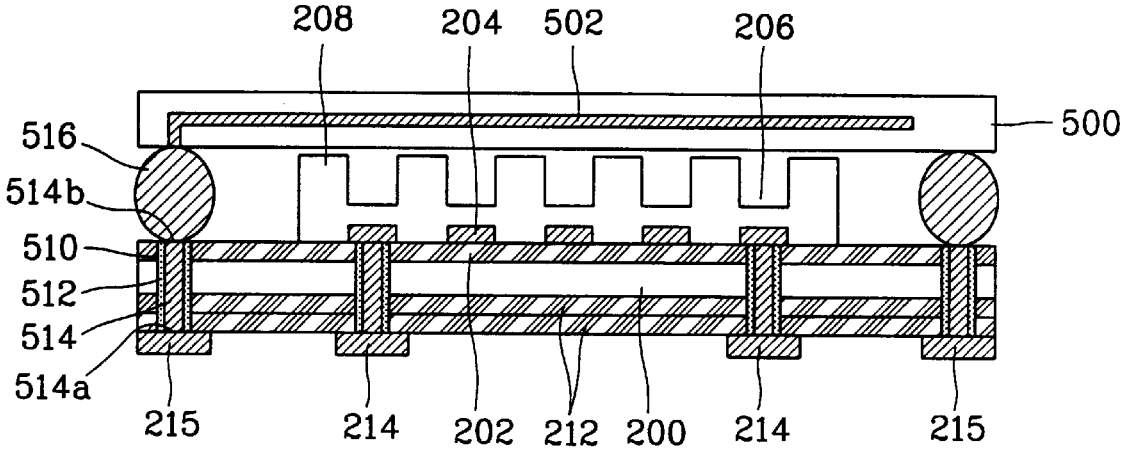
FIG. 5 is a view illustrating a PDP apparatus according to a third embodiment of the present invention.

The connection structure of the address electrode and driving circuit of the rear substrate is described with reference to FIGS. 3 and 4. FIG. 5 illustrates a connection structure of the sustain electrode and driving circuit.

As shown therein, a connection structure for connecting a front surface 500, a front substrate 500 and a sustain electrode 502, and the sustain electrode and the driving circuit is newly added. The remaining elements are the same as the embodiment shown in FIGS. 3 and 4. The same elements as the first and second embodiments of the present invention are given by the same reference numerals.

The structure for connecting the sustain electrodes and the PDP driving circuit of the front substrate will be explained.

First, a through hole 510 which passes through the first insulation layer 212 and the second insulation layer 202 formed at the metallic substrate 200 is formed at an edge portion of the metallic substrate 200. An insulation film 512 is coated on an inner wall of the through hole 510, and a conductive plug 514 is formed in the through hole 510 of the inner side of the insulation film 512. An end portion 514a of the conductive plug 514, namely, an end portion of the metallic substrate 200 is connected with the PDP driving circuit formed on the surface of the second insulation film 212 formed on the lower surface of the metallic substrate 200. In addition, the other end portion 514*b* of the conductive plug 514, namely, an end portion of the metallic substrate 200 is connected with the sustain electrode 502 installed at the front substrate 500.

In particular, the upper end portion 514*b* of the conductive plug and the sustain electrode 502 of the front substrate 500 are electrically connected by a solder bump 516.

Figure 6:
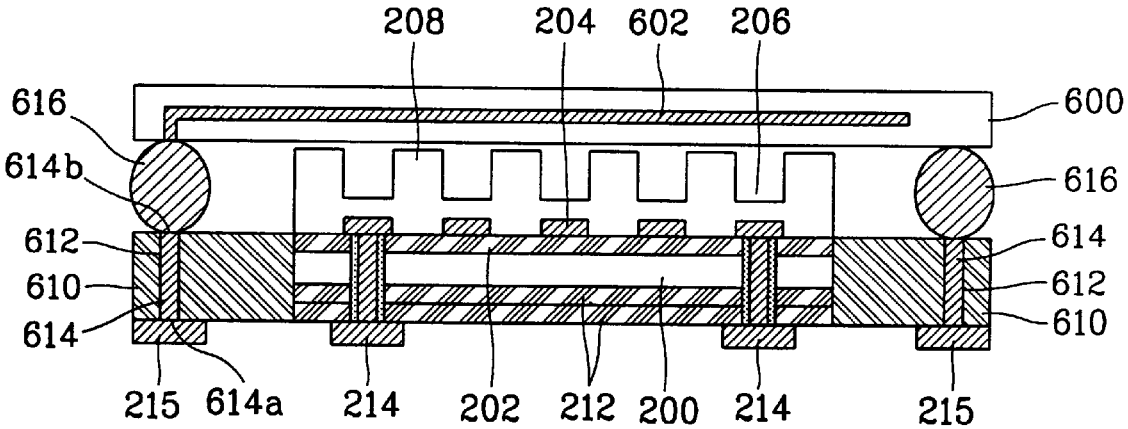
FIG. 6 is a view illustrating a PDP apparatus according to a fourth embodiment of the present invention.

FIG. 6 illustrates another embodiment of the connection structure for connecting the electrodes and the driving circuits of the front substrate. The elements of this embodiment of the present invention are the same as the elements shown in FIGS. 3 and 4 except for the construction of a front substrate 600 and a sustain electrode 602 and a connection structure for connecting the electrodes and driving circuits of the front substrate. Therefore, the description of the same elements will be omitted except for the connection structure for connecting the sustain electrodes and the driving circuits of the front substrate.

An insulation member 610 formed of a green tape is formed at an edge portion of the metallic substrate 200. A through hole 612 is formed at the insulation member 610. A conductive plug 614 is formed in the through hole 612. A lower portion 614a of the conductive plug 614 is electrically connected with the driving circuit 215, and an upper portion 614b of the conductive plug 614 is connected with the sustain electrode 602 formed at the front substrate 600 by a solder bump 616.

As described above, in the PDP apparatus according to the present invention, it is possible to implement a thin and light PDP apparatus by integrally forming the driving circuit unit and the panel unit.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. In a plasma display panel (PDP) apparatus having a panel unit formed of a plurality of discharge cells, and a driving circuit unit for supplying a power and signals to the panel unit, a PDP apparatus comprising:

a metallic substrate;

a first insulation layer formed on a first surface of the metallic substrate and including the driving circuit unit thereon;

a second insulation layer formed on a second surface of the metallic substrate, said first and second surfaces being opposing surfaces;

an upper substrate formed opposite to the second surface of the metallic substrate; and a plurality of barriers formed between the metallic substrate and the upper substrate for defining a plurality of discharge spaces of the plurality of discharge cells.

2. The apparatus of claim 1, wherein said plurality of barriers is formed by one of a press-molding a green tape, a screen painting of an insulation paste, and a barrier formation method.

3. The apparatus of claim 1, wherein at least one of said first and second insulation layers is green tape.

4. The apparatus of claim 1, wherein said metallic substrate serves as a base plate of a printed circuit board, and the first insulation layer is patterned to form a circuit for the driving circuit unit.

5. The apparatus of claim 1, further comprising a plurality of address electrodes formed on said second insulation layer, each address electrode being formed between adjacent barriers.

6. The apparatus of claim 5, further comprising a plurality of connection members to electrically couple said panel unit and the driving circuit unit.

7. The apparatus of claim 6, wherein each connection member comprises:

a through-hole formed in the metallic substrate;

an insulating film formed on inner walls of the through-hole; and a conductive plug formed in the hole to electrically couple said address electrode and the driving circuit unit.

8. The apparatus of claim 7 further comprising a driving circuit having a plurality of wires formed on the first insulating layer and coupled to said conductive plug.

9. The apparatus of claim 6, wherein each connection member comprises:

an insulation member formed at an edge of the metallic substrate;

a through-hole formed in the insulation member; and a conductive plug formed in the through-hole to electrically couple said address electrode and the driving circuit unit.

10. The apparatus of claim 9 further comprising a driving circuit having a plurality of wires formed on the first insulating layer and coupled to said conductive plug.

11. The apparatus of claim 6, wherein said upper substrate includes a plurality of sustain electrodes, and corresponding sustain electrodes being coupled to corresponding connection members.

12. A display panel apparatus comprising:

a panel unit having a front surface for displaying information and a rear surface;

a substrate formed on the rear surface, said substrate serving as a base plate of a printed circuit board having a driving circuit thereon for driving the panel unit; and a plurality of connection members electrically coupling the panel unit and the printed circuit board.

13. The apparatus of claim 12, wherein each connection member comprises:

a through-hole formed in the substrate;

an insulating film formed on inner walls of the through-hole; and a conductive plug formed in the hole to electrically couple said panel unit and the driving circuit.

14. The apparatus of claim 12, wherein each connection member comprises:

an insulation member formed at an edge of the metallic substrate;

a through-hole formed in the insulation member; and a conductive plug formed in the through-hole to electrically couple said panel unit and the driving circuit.

* * * * *